US005125213A

United States Patent [19]

Focke et al.

[11] Patent Number: 5,125,213

[45] Date of Patent: Jun. 30, 1992

[54] PROCESS AND APPARATUS FOR PACKING BULK MATERIALS

[75] Inventors: Heinz Focke, Verden; Harald Gosebruch, Hanover, both of Fed. Rep. of Germany

[73] Assignee: Focke & Co., Verden, Fed. Rep. of Germany

[21] Appl. No.: 723,024

[22] Filed: Jun. 28, 1991

[30] Foreign Application Priority Data

Jul. 30, 1990 [DE] Fed. Rep. of Germany ..... 4024984

[51] Int. Cl.[5] ..... B65B 1/22; B65B 9/00

[52] U.S. Cl. ..... 53/437; 53/525

[58] Field of Search ..... 53/437, 525; 222/200, 222/196, 198

[56] References Cited

U.S. PATENT DOCUMENTS

| | | | |
|---|---|---|---|
| 3,259,562 | 7/1966 | Larson | 222/1 |
| 4,174,599 | 11/1979 | Callet et al. | 53/525 X |
| 4,718,217 | 1/1988 | Ross | 53/525 X |
| 4,825,623 | 5/1989 | Ross | 53/437 |

FOREIGN PATENT DOCUMENTS

| | | | |
|---|---|---|---|
| 1200726 | 9/1965 | Fed. Rep. of Germany . | |
| 1901956 | 8/1970 | Fed. Rep. of Germany . | |
| 2444996 | 4/1976 | Fed. Rep. of Germany | 53/437 |
| 3721581 | 3/1988 | Fed. Rep. of Germany . | |
| 3938505 | 5/1990 | Fed. Rep. of Germany . | |
| 2347259 | 4/1976 | France . | |
| 1278562 | 6/1972 | United Kingdom . | |

*Primary Examiner*—James F. Coan
*Attorney, Agent, or Firm*—Sughrue, Mion, Zinn Macpeak & Seas

[57] ABSTRACT

A method and apparatus for making more efficient the filling of the tube bags (10) similar packages with bulk material of awkward shapes, especially with potato crips, so that the pieces of material to be packed do not get caught on one another. The tube bag (10), or a foil tube (14) for making the tube bag (10), is shaken or vibrated at least during a phase of the filling process and, in particular, immediately thereafter. This accelerates the filling process and, most important, frees the region where the bag-closure seam (20) is applied, of any residues of the material to be packed. Shaking or vibration effects are generated by oscillation generators (20,30) which preferably operate according to the principle of a loudspeaker, i.e. which set an air column into oscillation. The oscillations are then transferred to the foil tube (14) and the pack contents.

9 Claims, 3 Drawing Sheets

PROCESS AND APPARATUS FOR PACKING BULK MATERIALS

BACKGROUND OF THE INVENTION

The invention relates to a process for packing bulk materials, especially large-sized lump foods and luxury foods such as (potato) crisps, into packaging containers preferably (tube) bags made of plastic foil. The invention further relates to an apparatus for conducting the process.

The handling of bulk materials of awkward shapes, especially of light-weight potato crisps, creates particular problems in the packaging art. Such bulk materials are a normally packed in tube bags. To apply closure seams to this type of package is particularly problematic. Quite frequently, parts of the material to be packed are still left in the closure portion and thus make it difficult to apply the closure seam by means of thermal welding.

In a known apparatus for packing potato crisps in tube bags, a stripper means is assigned to the sealing means applying the closure seam which is directed transverse to the foil tube. After a process of filling the bag is completed this stripper means is guided on the outside along the packaging foil, that is to say along the foil tube, in the region where the closure seam is to be applied, and thus conducts a stripping movement. In this process, any residues of the material to be packaged are to be removed from the inside of the foil tube in this region. (EP-A-165 819).

When delicate materials, especially awkward-shaped potato crisps, are packed, the stripping movement along the outs side of the foil tube does not remove in a sufficiently reliable manner all residues from the region where the closure seam will be applied. As the residues of the material to be packed are to be removed by mechanical stripper means contacting the foil on the outside, there is a risk of damaging the material to be packed without efficiently stripping it down.

SUMMARY OF THE INVENTION

The invention is based on the object to improve the packing of delicate bulk materials into especially tube bags in such a way that in the region where the closure seam will be applied, no residues of the material to be packed are left.

To attain this object, the process as taught by the invention is characterized in that before the package is closed and while the material is filled into the package and/or when said material is located within the package, the bulk material is manipulated by being shaken or set vibrating to enhance the filling process and/or the density of the bulk material within the package.

According to the foregoing idea of the invention, the material to be packed or the packaging material is set vibrating at least during a phase of the packaging process. As a result, the material to be packed is introduced to the package in a faster and more careful way. It is, however, particularly important to remove residues of the material to be packed from the top portion of the pack (tube bag), so that subsequently the transverse closure seam can be applied in this region by sealing.

A vibration in the material to be packed or in the plastic foil of the tube bag may be generated in different ways, for instance by mechanical means which contact the tube bag to generate oscillations. But it is more expedient to generate oscillations in the bulk material and/or the packaging material without any direct contact, especially by means of air oscillations. These may be generated intermittently, especially during a final phase of the packaging process or only immediately thereafter, before the closure seam is applied.

The air oscillations can be generated by generators operating only mechanically, such as compressors. Of particular advantage are electrodynamic oscillation generators working according to the principle of a loud-speaker. A diaphragm is set oscillating electrodynamically. The oscillations are conducted via an air column and are transferred to the adjacent packaging material, namely to the foil tube or foil bag. As a result, oscillations are a also generated within the foil bag, namely in the material to be packed.

Further details of the invention relate to the structure of an apparatus for packing delicate bulk materials of awkward shapes. An illustrative embodiment of this apparatus will be explained below in more detail with reference to the drawings, in which:

DESCRIPTION OF A PREFERRED EMBODIMENT OF THE INVENTION

Figure 1:
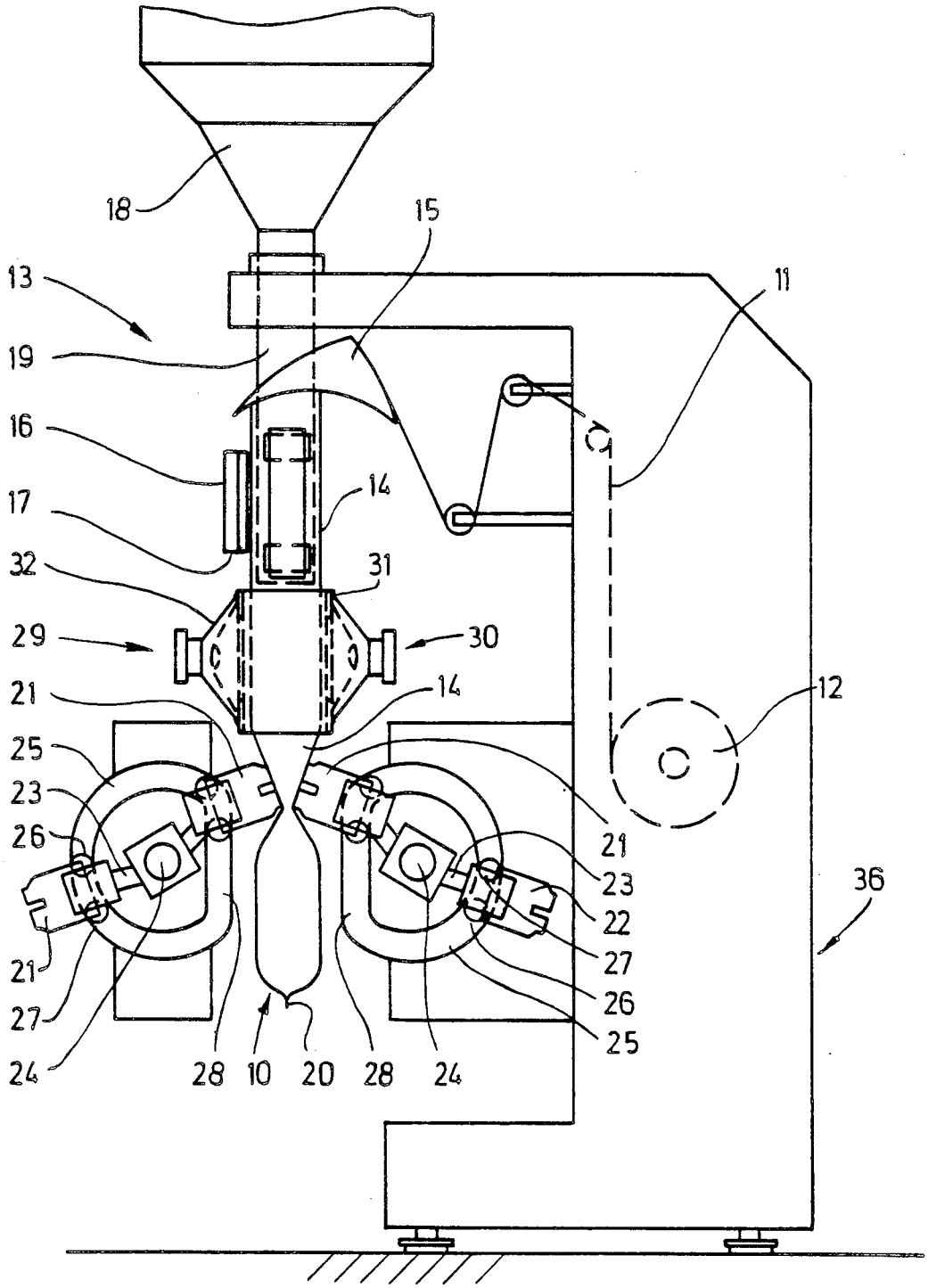
FIG 1. is a schematic side view of an apparatus for packing bulk materials such as potato crisps.
Figure 2:
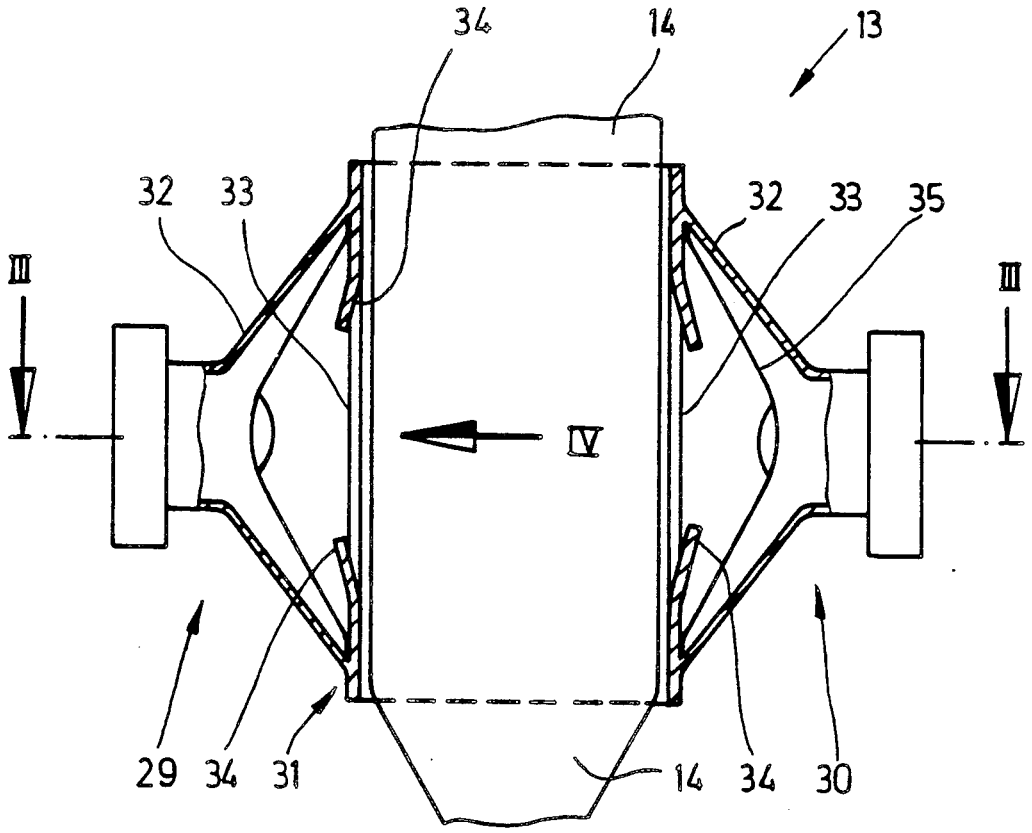
FIG. 2 is a vertical section of the apparatus according to FIG. 1, showing a detail on an enlarged scale.

The embodiment shown in the drawings relates to the production of bag packages, namely tube bags 10. The tube bags serve for accommodating bulk materials such as potato crisps.

The tube bags 10 are manufactured in the conventional way from a foil web 11 made of a thermally sealable plastic. The foil web 11 is drawn off a reel 12 and fed to a packaging station 13, where the originally flat foil web 11 is formed into a foil tube 14. For this purpose, the foil web 11 runs over a shaping member 15 which forms the foil tube 14 with overlapping longitudinal tabs. In the region of these longitudinal tabs, a sealing tool 16 applies a longitudinal seam, thus producing a foil tube 14 having a closed cross-section. Said foil tube 14 is conveyed in a downward direction by means of lateral conveyor belts 17.

The pack contents, e.g. potato crisps, are introduced via a feeding hopper 18. The material reaches an upright feeding pipe 19 which leads into the foil tube 14 surrounding the feeding pipe 19.

The pack contents are introduced in portions. Through the feeding pipe 19 and under gravity, the material to be packed reaches a free portion of the foil tube 14 below the feeding pipe 19. At the lower end of the foil tube 14, there is a bottom seam 20 directed transverse to the longitudinal extension of the foil tube 14. In the region of the bottom seam 20, the filled tube bag 10 is severed from the foil tube 14 by means of transversely directed cutting tools.

The bottom seam 20 is made by rotating sealing jaws 21, 22. In the present embodiment, two pairs of synchronously rotating sealing jaws 21, 22 are arranged in the region of a sealing station. Each pair of sealing jaws 21, 22 is attached to a common support arm 23 which is mounted on a shaft 24 and is driven to rotate. The sealing jaws 21, 22 at the ends of the support arms 23 are pivoted and are guided in a closed curved track 25. The sealing jaws 21, 22 run in the curved track 25 with guide rollers 26, 27. Said curved track 25 is designed such that a rectilinear upright guide portion 28 is formed adjacent the foil tube 14 or tube bag 10. In the region of this guide portion 28, two sealing jaws 21, 22 on both sides of the foil tube 14 are moved from the top to the bottom and thus press together a portion of the foil tube 14 and form the bottom seal 20. This bottom seal 20 is of double width, and a severing cut is applied through its middle to form an upper closure seam of a finished and filled tube bag and simultaneously a bottom seam 20 at the bottom end of the foil tube 14 for the following tube bag 10.

Every time a bottom seam 20 has been applied to the lower end of the foil tube 14, one lot of the bag contents is introduced. During this filling process, the foil tube 14 and/or the bag contents are set vibrating at least temporarily. This effects a certain orientation and compression of the bag contents. In particular, however, the vibration is generated towards the end of the filling process and immediately thereafter, i.e. before the upper closure seam (together with a new bottom seam 20) is applied. As a result of the vibration or shaking effect, the region where the bottom seam 20 and the upper closure seam are made is kept free of the material to be packed. Thus, the transverse seams can be applied by means of sealing without any faults.

Figure 3:
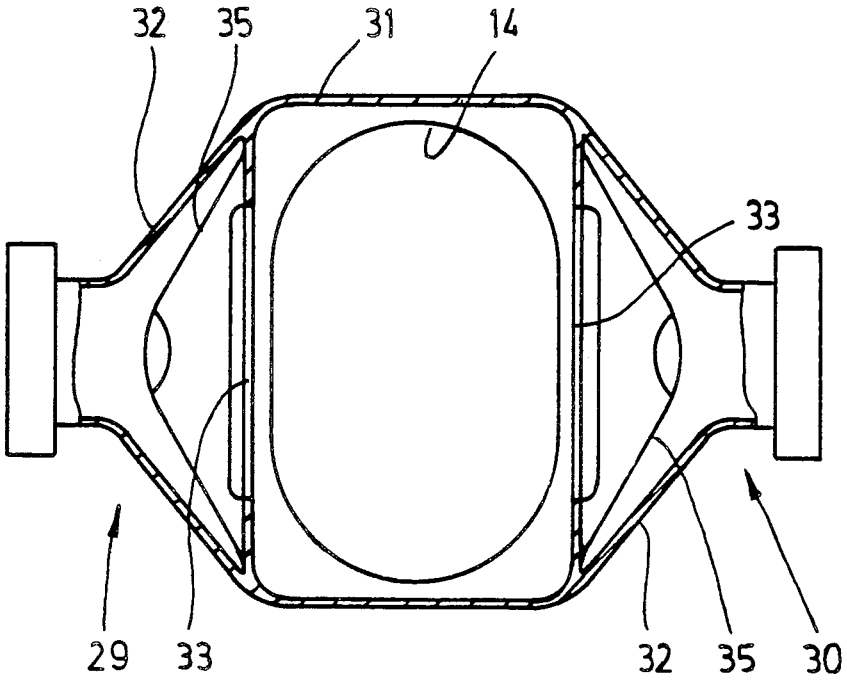
FIG. 3 is a horizontal section of the detail of FIG. 2, taken along the line III—III.
Figure 4:
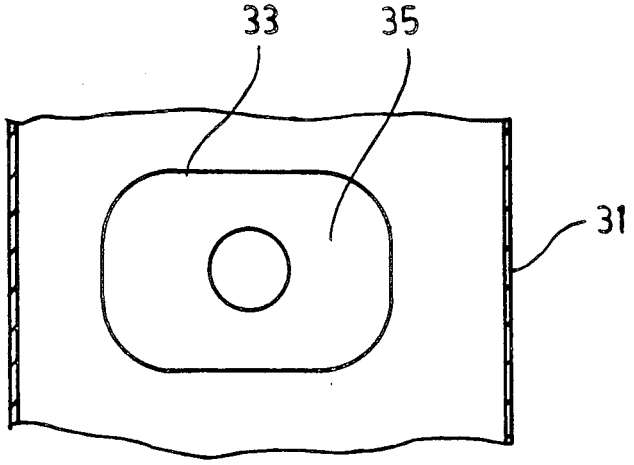
FIG. 4 is a view IV of the detail of FIG. 2.

For this purpose, an oscillation or vibration unit is arranged in the present embodiment above the sealing station formed by the sealing jaws 21, 22 for the bottom seam and closure seam. This unit temporarily generates oscillations in the foil tube 14 and/or in the material to be packed. In this embodiment, the vibration unit comprises two oppositely situated oscillation generators 29, 30. These are located on either side of the foil tube 14. A sleeve-like guide 31 is formed in the region of the oscillation generators 29, 30 and the foil tube 14 is led through said guide 31. The channel-like guide 31, which is open at the top and bottom, may have a circular, oval, square or—like in the present embodiment as shown in FIG. 3—a rectangular cross-section.

The oscillation generators 29, 30 are laterally attached to the guide 31, specifically with funnel-shaped housings 32. In the region of each oscillation generator 29, 30, the guide 31 is provided with an opening 33 which allows air waves to pass from the oscillation generators 29, 30 to the foil tube 14. Edges 34 of the openings 33 are shaped to the outside to avoid damages of the foil tube 14.

In the present embodiment, the oscillation generators 29, 30 operate electrodynamically, like a loudspeaker. A diaphragm 35 is set oscillating. The diaphragm 35 itself generates oscillations in the air column which is led through the openings 33 to the foil tube 14 and to the material to be packed within said foil tube. The generated oscillations lie in the lower frequency range, for example below 1000 Hz.

Oscillations in the packaging material and in the material to be packed are only generated for a limited phase of the filling process. Consequently, the oscillation generators 29, 30 are operated intermittently, at least immediately before the upper closure seam of a filled tube bag 10 (including a bottom seam 20) is applied. But the vibrations may also be generated while the material to be packed is still being filled in. The oscillations generated by the oscillation generators 29, on the one hand, and 30, on the other hand, may be balanced in phase or offset in phase relative to one another.

The feeding pipe 19 ends directly above the oscillation generators 29, 30 and the guide 31.

As shown by FIG. 1, the complete apparatus is mounted on a machine frame 36.

What is claimed is:

1. In a process for packing bulk material into a tube bag made of plastic foil, the bulk material being manipulated by being shaken or vibrated to enhance both a process of filling the tube bag and also the density of the bulk material within the tube bag before the tube bag is closed and while the tube bag is being filled with the bulk material into the package, the improvement comprising the step of intermittently vibrating, in a non-contact manner, the bulk material and the tube bag (10) by means of air vibrations.

2. The process as claimed in claim 1, wherein said vibrating step comprises setting the bulk material and the tube bag (10) in oscillation during a final phase of the filling process or immediately thereafter in order to remove residues of the bulk material from a region of a filling opening of the tube bag, which region is to be provided with a closure seam.

3. The process as claimed in claim 2, wherein the air vibrations take effect on the tube bag (10) from at least two oppositely situated sides of the tube bag.

4. The process as claimed in claim 2, wherein the air vibrations are generated by oscillations of at least one electrodynamic oscillation generator (29, 30) according to a loudspeaker principle.

5. The process as claimed in claim 4, wherein the air vibrations are generated by two electrodynamic oscillation generators (29, 30) disposed on opposite sides of the tube bag.

6. The process as claimed in claim 4 or 5, wherein said oscillations have a frequency below 1000 Hz.

7. In an apparatus for packing bulk material into a tube bag, made of plastic foil, in a filling station which includes both a filling means, for introducing the bulk material downwardly in a free fall into an upwardly open tube bag to fill the bag, and a closing means for closing the tube bag with a closure seam after filling of the tube bag has been completed, said filling station also including oscillation-generating means (29, 30) for vibrating the tube bag and the bulk material during or after the filling of the tube bag, the improvement comprising a sleeve-like guide (31) for guiding and surrounding the tube bag during the filling thereof, wherein said oscillation-generating means (29, 30) is located adjacent said sleeve-like guide (31) and out of contact with the tube bag and the material, and wherein said guide (31) has openings (33) located adjacent to said oscillation-generating means (29, 30).

8. The apparatus as claimed in claim 7, wherein said oscillation-generating means comprises a pair of electrodynamic oscillation generators which set in vibration air-columns directed through said openings (33), in the manner of a loudspeaker.

9. The apparatus as claimed in claim 8, wherein each air-column vibrates at a frequency below 1000 Hz.

* * * * *